United States Patent [19]

Thiel

[11] Patent Number: 5,058,951

[45] Date of Patent: Oct. 22, 1991

[54] RECLINABLE SWING CHAIR

[76] Inventor: Lawrence A. Thiel, Box 115, Shepardsville, Ind. 47880

[21] Appl. No.: 645,598

[22] Filed: Jan. 25, 1991

[51] Int. Cl.[5] ..... A47D 13/10; A63G 9/00

[52] U.S. Cl. ..... 297/278; 248/370; 297/273

[58] Field of Search ..... 297/273, 277, 278, 279, 297/280, 281, 282; 248/370, 327, 328; 5/124, 125, 126, 127, 128, 129, 130; 272/85, 86, 87, 88, 89, 90, 91, 92

[56] References Cited

U.S. PATENT DOCUMENTS

| | | | |
|---|---|---|---|
| 331,434 | 12/1885 | Peck | 297/278 |
| 1,013,956 | 1/1912 | Sanders | 297/279 |
| 1,511,806 | 10/1924 | Englander | 5/124 |
| 1,815,185 | 7/1931 | Cobb | 297/281 |
| 2,520,377 | 8/1950 | Schrougham | 297/278 |
| 3,897,104 | 7/1975 | Black . | |
| 4,258,952 | 3/1981 | Dutra . | |
| 4,268,087 | 5/1987 | Sorrentino . | |

*Primary Examiner*—Peter R. Brown
*Assistant Examiner*—James M. Gardner
*Attorney, Agent, or Firm*—H. John Barnett

[57] ABSTRACT

A relinable swing which is suspended from cables or chains, or similar flexible rope or linked bars. The swing suspenion connects on both sides of the seat portion, and a sliding connection to the back. The sliding connection means are a pair of Z-bar shaped brackets which are fastened to the back of the swing seat at the sides. When both sides of the suspension is in the upper position on the respective Z-bar brackets, the swing seat is in the reclining position. When they are in the lower position, which is closer to the back of the seat, the swing is in the upright position.

3 Claims, 1 Drawing Sheet

RECLINABLE SWING CHAIR

BACKGROUND OF THE INVENTION

1. Field of the Invention

This invention is directed to a reclinable swing which is suspended from cables or chains.

2. Description of the Related Art

There are many types of reclinable or swinging chairs, some with elaborate systems for changing position. For example, U.S. Pat. No. 3,897,104 describes a convertible swingable chair which comprises a plurality of arcuate sections which are pivotally hung aligned pivots supported on pedestals at each side of a circular or oval base. The swinging action is about the aligned pivots, so there is no horizontal component of motion. U.S. Pat. No. 4,258,952 describes a rocking couch having a pair of interconnecting chambers, at least partially filled with fluid. The rocker rests on a horizontal surface and has an arcuate lower surface which enables the user to shift from a sitting to a reclining position by shifting his weight. The fluid in the chambers shifts more gradually to provide a smooth transition of position, and to serve as a leverage device to facilitate rocking motion.

U.S. Pat. No. 4,268,087 discloses a swinging chaise lounge which is mounted on a stand. The chaise lounge is suspended from the stand in such a way that a user can safely place himself on the chaise lounge without assistance, and then tip to the reclining position. Shrouds 24 and 25 support the chaise lounge in the reclining position, which is the only position in which swinging motion is possible.

SUMMARY OF THE INVENTION

This invention is directed to a reclinable swing which is suspended from double-ended cables or chains which connect at one end to the sides of the swing seat, and at the other end to a pair of "Z" brackets. The "Z" brackets are secured to the sides of the backrest of the swing.

The double-ends of the cables or chains join together into single cables or chains which extend upwardly to suspension brackets in a ceiling, a support frame, a tree branch, or any solid overhead support capable of holding the loaded weight of the swing, plus a margin of safety.

The most important feature of the invention are the "Z" brackets which provide two-point connections for one end of each of the double-ended chains to the corresponding sides of the backrest of the swing. The lower "Z" bracket elbows provide the connection points for the chain or cable ends when the swing is in the upright position. When it is desired to move the swing to the reclining position, the chain or cable ends are moved to the upper "Z" bracket elbows, and the swing backrest tilts back, while the legrest pivots upward to rotate the swing to the reclining position. Moving the chain or cable ends back to the lower "Z" bracket elbows causes the backrest to tilt upwardly and the legrest to again pivot down so that the swing resumes the upright, or sitting position. The change of swing position may be made manually by the occupant of the swing because the occupant may shift his weight until he is supported mostly by the ends of the chain which connect to the sides of the swing seat. This shift of weight makes it easy to move the respective chain or cable ends to the other "Z" bracket elbows.

DESCRIPTION OF THE PREFERRED EMBODIMENT

Figure 1:
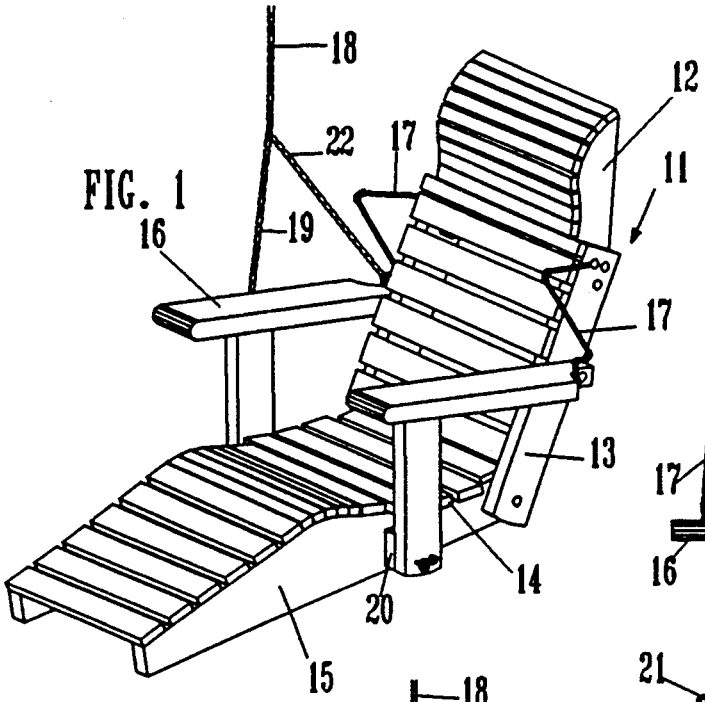
FIG. 1 of the drawings is a perspective view of the reclining swing in the upright position showing the lower end of the right, double-ended suspension chain.
Figure 2:
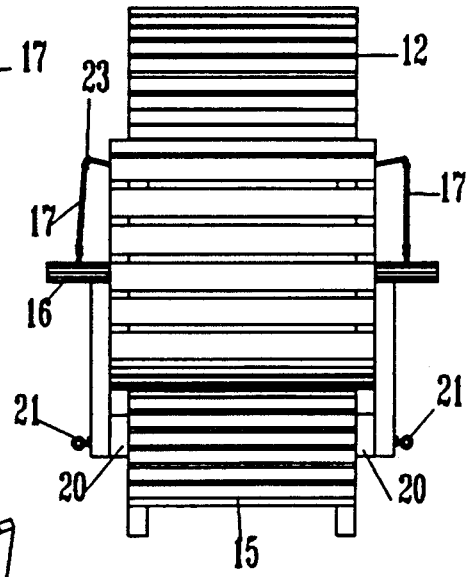
FIG. 2 is a front view of the reclining shown in FIG. 1 showing the side extension of the "Z" brackets.

As shown in the drawings, a reclining swing 11 includes a headrest 12, a backrest 13, a seat 14, legrest 15, armrests 16, "Z" brackets 17, and double-ended suspension chains 18. End 19 of each double ended suspension chain 18 is connected at the respective side 20 of the seat 14 to chain bracket 21 which is secured in the corresponding side 20 of the seat 14. The other double end 22 of each chain 18 is slidably connected to the corresponding "Z" bracket 17.

Figure 3:
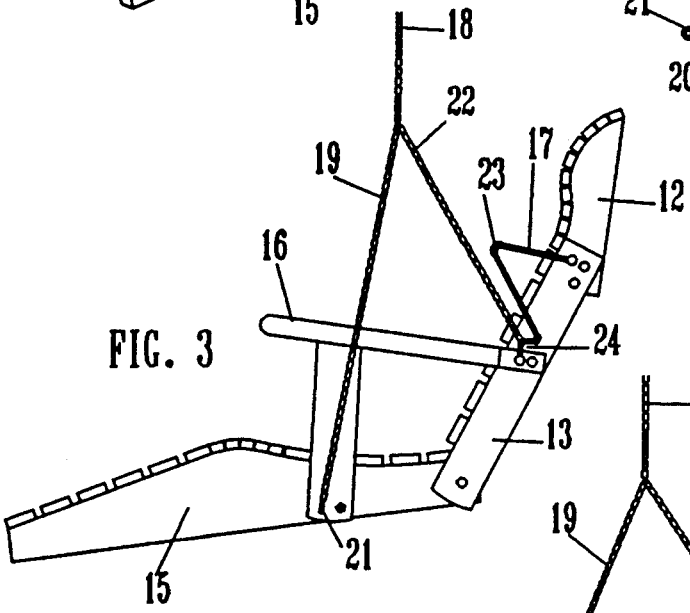
FIG. 3 is a schematic side elevation of the reclining swing in the upright sitting position to show one chain or cable end on the lower elbow of one of the "Z" brackets.
Figure 4:
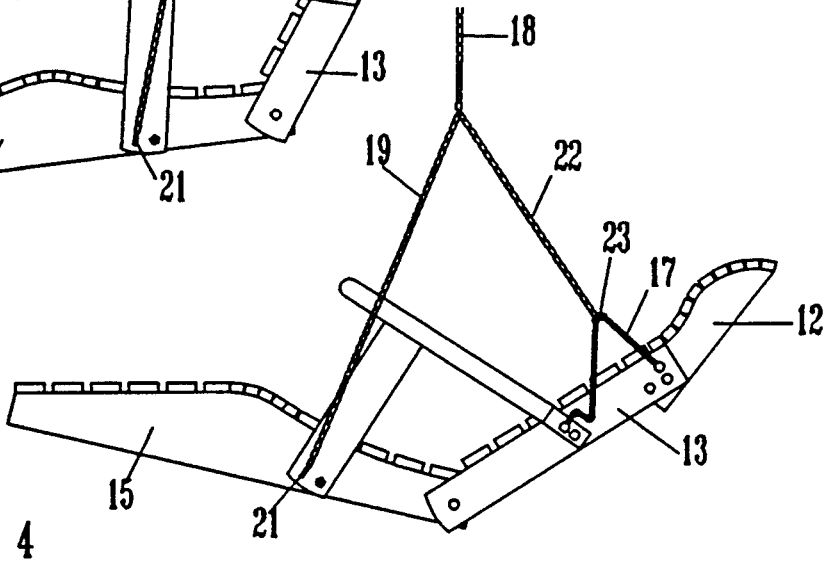
FIG. 4 is a schematic side elevation of the reclining swing in the reclining position to show one chain or cable end position on the upper elbow of one of the "Z" brackets.

Each "Z" bracket includes a relatively large, upper elbow 23 and a smaller, lower elbow 24. As best seen in FIG. 3, when the ends 22 of the suspension chains 18 are connected at the smaller, lower elbows 24, the swing 11 remains in an upright, sitting position. When the ends 22 of the suspension chains 18 are connected at the upper, larger, elbows 23, the swing 11 is tilted back to the reclining position, as can be best seen in FIG. 4.

The swing suspension of the invention, which includes the double-ended suspension chains 18 and the "Z" brackets provides a relatively simple and inexpensive means to make a swing which can be moved easily from an upright, sitting position to a reclining position, and back again. The positions of the chain ends on the corresponding "Z" brackets determines whether the seat will be in the upright or the reclining position.

What is claimed is:

1. In a reclinable swing having a backrest and a seat which is suspended from chain, ropes or cables, a pair of "Z"-shaped brackets, each connected to a side of the backrest, said "Z"-shaped brackets each having a relatively large, upper elbow and a smaller, lower elbow, and a pair of chains, ropes or cables for suspending the reclinable swing, each chain, rope or cable having a pair of lower ends, one of the lower ends being connected to the corresponding side of the swing seat and the other lower end being slidably connected to one of said elbows of the corresponding "Z"-shaped brackets to support the reclinable swing in either an upright or a reclining position.

2. The reclinable swing of claim 1, in which the respective ends of the chains, ropes or cables are connected to the corresponding smaller, lower elbows of the corresponding "Z"-shaped bracket to orient the swing to the upright, sitting position.

3. The reclinable swing of claim 1, in which the respective ends of the chains, ropes or cables are connected at the upper, larger elbows of the corresponding "Z"-shaped bracket to orient the swing to the reclining position.

* * * * *